United States Patent [19]

Olsson

[11] Patent Number: 4,722,113

[45] Date of Patent: Feb. 2, 1988

[54] MOP HANDLE STABILIZER

[76] Inventor: Arvid T. Olsson, 49 Firth Rd., Roslindale, Mass. 02131

[21] Appl. No.: 803,242

[22] Filed: Dec. 2, 1985

[51] Int. Cl.[4] ..... A47L 13/58

[52] U.S. Cl. ..... 15/264; 15/143 R; 15/257 R; 211/66; 248/111

[58] Field of Search ..... 15/257 R, 260–264, 15/143 R; 248/110, 111, 113, 129, 220.2, 221.3–225.2; 211/60.1, 65, 66; 220/85 D, 96

[56] References Cited

U.S. PATENT DOCUMENTS

| | | | |
|---|---|---|---|
| 1,086,858 | 2/1914 | Richards | 248/110 |
| 2,584,219 | 2/1952 | Murrell | 15/257 R |
| 2,655,681 | 10/1953 | Swanson | 15/262 |
| 3,540,687 | 11/1970 | Cuva | 248/223.4 |
| 3,756,451 | 9/1973 | Popeil | 15/264 |
| 4,121,798 | 10/1978 | Schumacher et al. | 248/113 |

*Primary Examiner*—Edward L. Roberts
*Attorney, Agent, or Firm*—William Nitkin

[57] ABSTRACT

A mop handle stabilizer having a mop handle receipt member positioned on an inside upper portion of said bucket and a mop handle projection positioned on a mop handle adapted for the mop handle projection to be engaged into said mop handle receipt member to hold the mop in an upright position in the bucket.

1 Claim, 2 Drawing Figures

MOP HANDLE STABILIZER

BACKGROUND OF THE INVENTION

1. Field of the Invention

The device of this invention resides in the area of devices to hold a mop upright within a mop bucket and more particularly relates to an attachment device having a first portion which attaches to the mop handle and a second portion which attaches to the mop bucket which portions when interconnected, hold the attached mop upright within the bucket to prevent it from tipping.

2. Description of the Prior Art

The problem of mops left unattended within a mop pail or bucket has long been appreciated. When mops are left unattended in a bucket, they frequently fall over to one side which is inconvenient and also creates a hazard as someone could walk into the handle or the handle could mark the wall it falls against. In some cases the mop can fall completely out of the bucket because of the heaviness of the mop handle. When a mop falls out of its bucket, water from the pail can spill onto the floor. Accidents can also occur when using mop buckets with wheels for easy maneuverability. If a mop handle falls against a wall, often pressure from the weight of the mop handle will cause the mop bucket's wheels to move away from the wall thereby possibly causing an accident to occur.

SUMMARY OF THE INVENTION

It has long been desirable to provide means to attach a mop handle to a mop bucket and it is for this purpose that the device of this invention has been designed. The device of this invention consists of two basic parts: a mop handle attachment member which attaches to the mop and is secured thereto and does not interfere with the use of the mop in any fashion, and a bucket attachment member which is attached to the upper inner side of the bucket. The mop handle attachment member and bucket attachment member have means to engage one another when the mop is placed in the bucket and the interconnected parts securely hold the mop in an upright position. The two parts of the device of this invention can be engaged and disengaged quickly. The device is constructed with no moving parts so that it is both economical to produce and easy to utilize.

In its simplest embodiment the device consists of a handle attachment member having a semi-circular channel defined therein forming a handle receipt slot adapted to be of a diameter to fit around the mop handle which handle is retained therein by handle attachment means such as screws through the side of the handle attachment member. The handle receipt slot receives the mop handle securely and in some embodiments can be designed to grasp around and be securely retained on the mop handle. Such embodiments can be made of a resilient material such as plastic. The handle attachment means such as screws can be positioned through apertures formed in the sides of the handle attachment member, a portion of which should be open or openable for insertion of the mop handle into the handle receipt slot. The handle attachment member has a portion thereof which extends away from the handle attachment member and forms a handle attachment projection. This projection is adapted to extend downward and parallel to the axis of the mop handle, and between the handle attachment projection and the handle attachment member is formed a projection slot of a specific dimension. The projection is tapered at its end as will be described below to assist in easy insertion of the tapered projection into the bucket attachment means.

The bucket attachment member is comprised first of a planar member which is affixable to the inside of the bucket. Since some buckets are square while others are round, the planar member should be constructed in a shape complementary to the shape of the bucket. For example if the bucket is round, the planar member should be curved along the direction of the curve of the bucket; and if the bucket is rectangular and has flat walls, then the planar member should be flat. The planar member can include attachment means to attach it to the bucket. One such attachment means can consist of four apertures formed within the planar member for receipt of bolt members which would pass through such apertures into holes made in the bucket to nut members. When the nuts and bolts are tightened, the bucket attachment member would be securely affixed to the bucket. The bucket attachment member has formed therein a bucket attachment receipt slot which is an elongated aperture extending in a vertical direction adapted to receive the projection member of the handle attachment member. The bucket attachment receipt slot can be formed by two sides, being the bucket attachment member slot's first side and second side both of which extend from, are attached to, or formed as part of and extend out the bucket attachment planar member and along their fronts are joined by a bucket attachment front member forming an internal slot. A receipt notch is formed from the bucket attachment front member not extending as far upwards as the side bucket attachment member slot's first or second sides. Within such receipt notch is received the projection's slot so the top of the projection slot contacts the bucket attachment front member and the projection slot mates with the receipt notch of the bucket attachment member. The projection is of a dimension which fits snugly within the bucket attachment receipt slot but the fit should not be so tight-fitting that easy removal and insertion of the mop handle are hampered.

DESCRIPTION OF THE PREFERRED EMBODIMENT(S)

Figure 1:
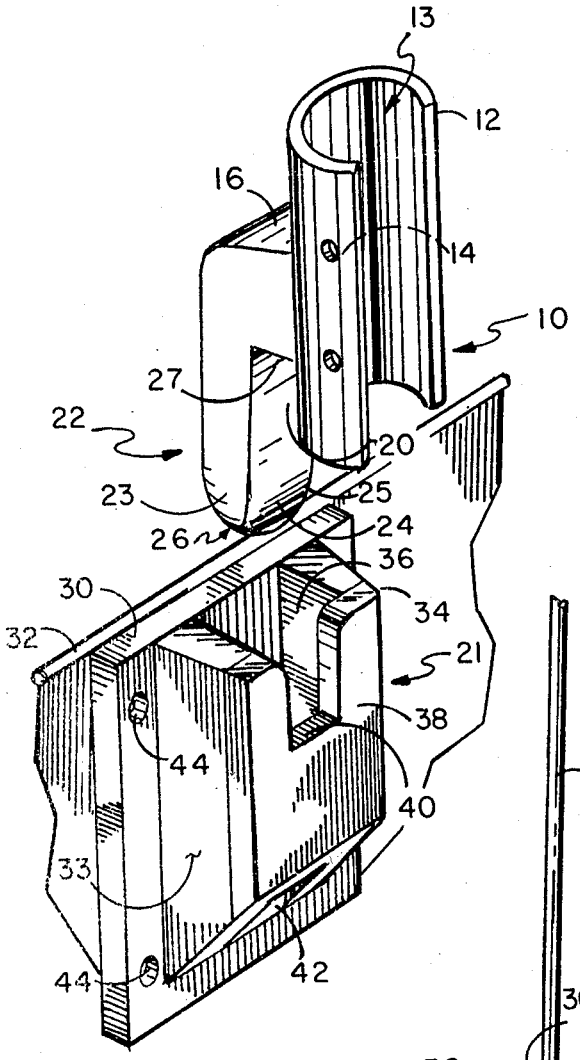
FIG. 1 illustrates a three-quarter perspective view of the handle attachment member and bucket attachment member separated from one another with the projection member about to engage down into the bucket attachment member receipt slot.

FIG. 1 illustrates handle attachment member 10 poised above bucket attachment member 21, such handle receipt member 10 about to be moved down so as to engage handle attachment member projection 22 into bucket attachment receipt slot 36. These members can be made of plastic such as polyethylene or polypropelene or metal such as cast aluminum or any other equivalent material. They can also be formed as an integral part of the bucket and as an integral part of the mop handle. Seen in this view is handle receipt slot 13 adapted to receive mop handle 8 therein formed in the handle attachment member. Handle attachment means of any kind can be utilized to securely affix the handle attachment member to the mop handle. As illustrated in FIG. 1, apertures 14 are provided so that screws or pins can be passed through sides 12 of handle attachment member 10 into the mop handle so that the handle attachment member is securely positioned thereon. Handle attachment member 10 has handle attachment projection member 22 extending offset by body section 16 from the handle receipt portion thereof and as projection member 22 extends vertically downward parallel to the handle receipt portion, it is then separated therefrom by projection slot 20. Handle attachment projection member 22 has its first side 23 and second side 25 tapered to ease its positioning and insertion into bucket attachment receipt slot 36 with front outer projection taper 26 being slighter than inner projection taper 24 which extends all the way up unto projection slot 20 and the projection member extends straight up to the top 21 of projection slot 20 to form an open area which will securely affix onto bucket attachment member front 38 which is of a complementary diameter, usually ⅜th of an inch, to securely affix mop handle attachment member 10 in position on bucket attachment member 21 to prevent any wiggling thereof.

Figure 2:
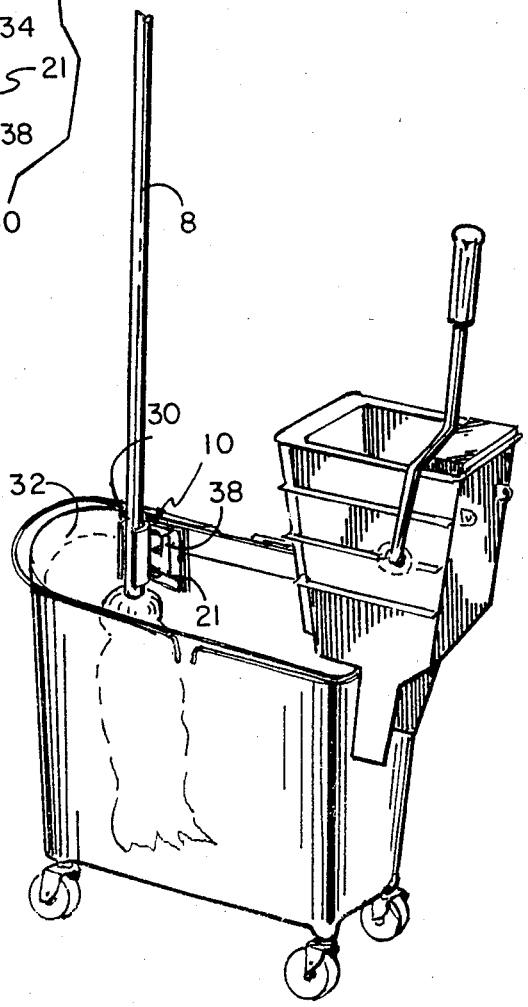
FIG. 2 illustrates a bucket and a mop having thereon the handle member attachment means which is engaged into the bucket attachment member affixed to the inside of said bucket.

In FIG. 2 bucket attachment member 21 can be affixed to the inside of bucket 32. As discussed above, bucket attachment member rear 30 is generally planar but should conform either to the flatness or curvature of the inside of bucket 32. Bucket attachment member 21 must be provided with suitable bucket attachment means such as glue or other means sufficient to hold it in place. What has been found to be successful is to provide a plurality of bucket attachment member apertures 44 therein with mating apertures in the bucket's side and passing bolts therethrough to bolt the bucket attachment member to the inside of the top of the bucket. In FIG. 1 bucket attachment receipt slot 36 is formed having a first side member 33 and a second side member 34 and a bucket attachment front member 38 of a thickness that substantially matches the width of projection slot 20. Receipt slot 40 is formed because bucket attachment member front 38 does not extend all the way up to the top of the first and second side members 33 and 34, respectively, of bucket attachment receipt slot. Receipt slot 40 is complementary to projection slot 20 which is passed thereover when handle attachment projection member 22 is engaged into bucket attachment receipt slot 36 so that projection slot 20 of handle attachment member 10 passes over bucket attachment member front 38 and the handle is securely retained in position.

Although the present invention has been described with reference to particular embodiments, it will be apparent to those skilled in the art that variations and modifications can be substituted therefor without departing from the principles and spirit of the invention.

I claim:

1. A mop handle retention device adapted to hold a mop within a mop bucket comprising:

a bucket attachment member adapted to be affixed to the inside top of said bucket;

means to affix said bucket attachment member to the inside of said bucket;

a first bucket attachment side member extending outward from said bucket attachment member;

a second bucket attachment side member extending outward from said bucket attachment member parallel to said first bucket attachment member;

a bucket attachment member front interconnecting said first bucket attachment member's first side and said bucket attachment member's second side, the top of said bucket attachment member front being positioned below the top of said bucket attachment member's first and second sides all defining therebetween a bucket attachment receipt slot;

a handle attachment member having a handle receipt slot defined therein adapted to receive and to be engaged upon a mop handle;

handle attachment means to attach securely said handle attachment member to said mop handle;

a mop handle attachment projection member extending from said handle attachment means downward and parallel to said mop handle having a projection slot defined between said mop handle attachment projection member and the body of said handle attachment member, said projection slot having a width approximately the same as the width of said bucket attachment member front, said mop handle attachment projection member being tapered and adapted for easy engagement into said bucket attachment receipt slot, said mop handle attachment projection member having an inner tapered projection extending upward to said projection slot all adapted for said mop handle attachment projection member to be inserted and engaged into said bucket attachment member's receipt slot and for said projection member to contact the inner side of said projection slot and said bucket attachment member to contact the top of said projection slot.

* * * * *